United States Patent [19]

Abrahamson

[11] 4,308,719

[45] Jan. 5, 1982

[54] FLUID POWER SYSTEM

[76] Inventor: Daniel P. Abrahamson, 3030 N. 56th Dr., Phoenix, Ariz. 85301

[21] Appl. No.: 65,136

[22] Filed: Aug. 9, 1979

[51] Int. Cl.[3] ..... D01H 3/12

[52] U.S. Cl. ..... 60/325; 60/485; 60/593; 60/669; 91/354; 91/506

[58] Field of Search ..... 60/325, 669, 670, 485, 60/593; 417/399; 91/354, 506

[56] References Cited

U.S. PATENT DOCUMENTS

| | | | |
|---|---|---|---|
| 2,369,365 | 2/1945 | Nichols | 417/399 |
| 2,661,592 | 12/1953 | Bright | 60/325 |
| 3,133,447 | 5/1964 | Mercier | 60/325 |
| 3,991,574 | 11/1976 | Frazier | 60/325 |
| 4,011,723 | 3/1977 | Ross | 60/325 |
| 4,070,862 | 1/1978 | Doerner | 60/669 |
| 4,110,980 | 9/1978 | Foulke | 60/325 |
| 4,163,632 | 8/1979 | Hinchman | 417/399 |

*Primary Examiner*—Abraham Hershkovitz
*Attorney, Agent, or Firm*—Gregory J. Nelson

[57] ABSTRACT

A fluid power apparatus for converting steam to hydraulic energy having one or more pairs of linear steam and linear hydraulic cylinders arranged symmetrically and with their axis parallel about a steam generator. The rod ends of the cylinders are connected to a wobble plate. Valving directs steam in and out of the steam cylinders and as the steam cylinders reciprocate, the corresponding hydraulic cylinders will be reciprocated generating hydraulic fluid pressure. Valving is accomplished by valving plates rotated by the wobble plate or by means of a slide valve positioned by a wobble plate actuated linkage.

8 Claims, 24 Drawing Figures

FLUID POWER SYSTEM

The present invention relates to a fluid power system and more particularly to a system for converting steam energy to hydraulic energy. In a more specific aspect of the present invention, steam cylinder linear motion is converted to hydraulic cylinder linear motion on a one-to-onebasis.

Steam has been used for many years to develop rotary motion by using steam power to reciprocate a cylinder which, in turn, actuates a crank arm on a drive shaft. Expansion of steam across a turbine to convert steam power to rotary motion is also known. Both of these applications have certain deficiencies. The steam cylinder crank arm arrangement is inefficient as the thrust of the cylinder is converted to rotary as a function of the angle of the crank arm to the cylinder. When the crank arm is positioned at ninety degrees to the center line of the cylinder, maximum torque is generated which occurs only twice in each revolution of the shaft.

Steam turbines are well-suited for constant speed applications but do not generally function well under varying loads or speeds. Further, turbines have a slow response time to speed changes and efficiency drops off severely at slow speeds. Some attempts have been made to develop devices to directly convert steam to rotary motion but generally such devices have not been practical as the ability to contain and control live steam, a gas, in rotary chambers is beyond the state of the seal art.

The present invention takes advantage of the ability of steam cylinders to contain and control live steam and convert it efficiently to linear motion and the ability of hydraulic motors to efficiently convert hydraulic fluid energy to rotary motion. Some attempts have been made to use steam cylinders to reciprocate hydraulic cylinders when they are mounted directly in line with one another. Certain problems are exhibited with this arrangement including heat transfer as steam heats the hydraulic oil because the cylinders are connected. Valving also becomes a problem if more than one set of hydraulic and steam cylinders are used as the oil will pulse and flow rates vary. Additionally, the units will not run smooth as there is generally no provision for acceleration or deceleration of the cylinder pistons.

The present invention provides an efficient system for converting steam power to hydraulic energy on a one-to-one basis. A series of steam and hydraulic cylinders, with their axial center lines parallel, are positioned so that the rod ends of the cylinders are pivotally connected to a reciprocal connecting plate. The steam and hydraulic cylinders are arranged in a balanced relationship about the periphery of a mounting plate. A swash plate is in driven engagement with cylinder connecting plate. The cylinder connecting plate acts as a lever with its center being the fulcrum. As the steam cylinder is cycled, the opposite hydraulic cylinder will be reciprocated. The swash plate imparts acceleration and deceleration to the hydraulic cylinder stroke creating smooth operation and reducing pulses and uneven flows. The rotating swash plate rotates a valve plate to direct steam to and from the steam cylinders and to synchronize their action for even pumping of the hydraulic fluid.

In the preferred embodiment, the hydraulic and steam cylinders are arranged on the circumference of a circle about the boiler for a compact, safe and efficient arrangement. In an alternate embodiment of the invention, valving of the steam is accomplished by a steam chamber and slide valve arrangement, the slide valve being positioned by a linkage connected to a shaft rotated by the swash or wobble plate. Auxiliary equipment, such as a fixed displacement water pump may also be driven from the swash or wobble plate to provide make-up water to the steam generation system.

The above and other advantages of the present invention will become more apparent from the following specification, claims and drawings in which:

Figures 1, 2, 3:
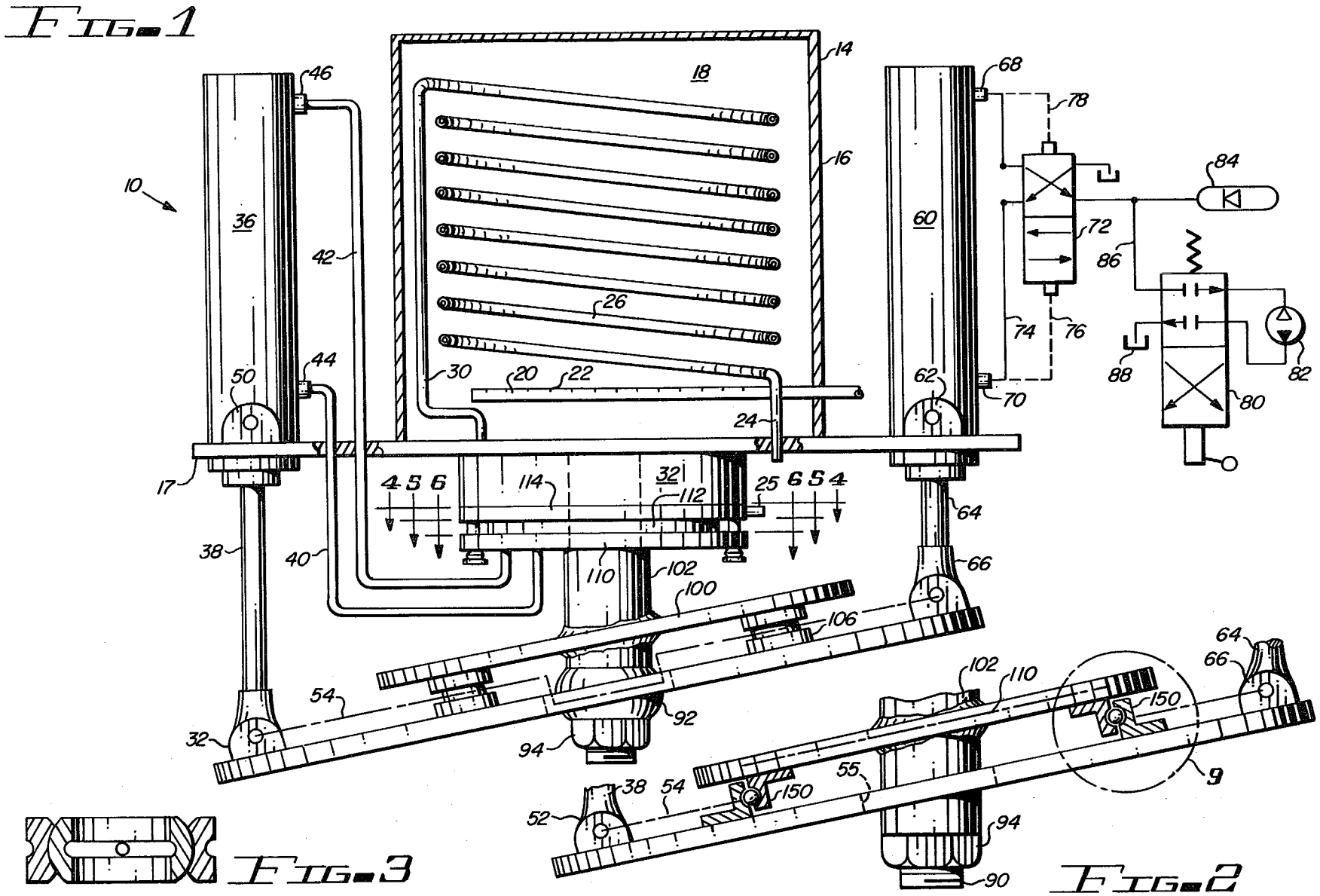
FIG. 1 is a side elevational view, partly broken away, illustrating the power unit of the present invention connected to a hydraulic system, the hydraulic system being shown schematically.
FIG. 2 is a side elevational view of an alternate connecting plate and swash plate assembly.
FIG. 3 is a cross-sectional view of the spherical bearing connection between the shaft and the connector plate.

The present invention will be more fully understood from the following description. Turning now to the drawings, particularly FIGS. 1 and 3 to 8 and 10. In those drawings a power conversion unit is generally designated by the numeral 10 and includes a base plate 12 shown as being generally circular. Boiler unit 14 is concentrically disposed on base plate 12 and includes an outer housing or shell 16 defining a boiler chamber 18. A burner 20 is located in the lower part of chamber 18 and is shown as gas burner having a series of orifices 22 for discharge of gas or other fuel to support combustion. Water to be heated enters the boiler chamber 18 at inlet 24 and circulates through tube 26 formed as a series of helical coils. As the water is heated, the water rises and turns to steam within the coils being discharged from the steam chamber at outlet 30. Outlet 30 is connected to steam distribution valve 32 as will be more fully explained hereafter.

Figure 10:
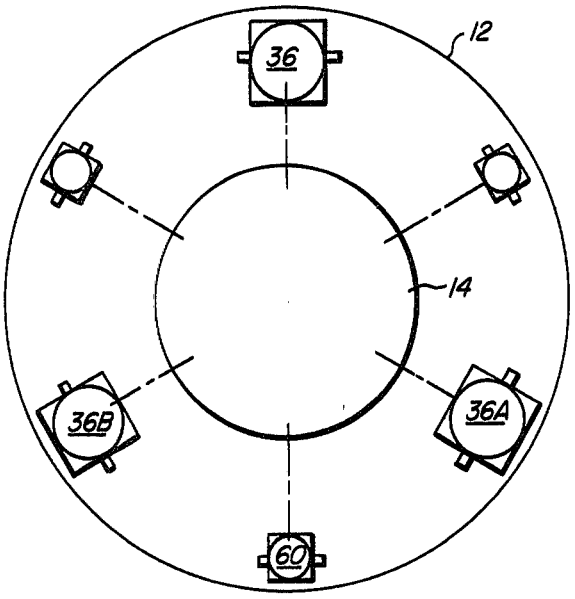
FIG. 10 is a top view showing one arrangement of the steam and hydraulic cylinders arranged about the boiler.

As best seen in FIG. 10, a plurality of pairs of oppositely disposed hydraulic cylinders 60 and steam cylinders 36 are mounted about the periphery of base plate 12 about the boiler 14. The arrangement with steam cylinders and hydraulic cylinders diametrally opposite is a preferred arrangement. However, other balanced or symmetrical arrangements to the hydraulic and steam cylinders may be utilized. Steam cylinders 36 are shown as linear cylinders of conventional construction having an internally reciprocating piston, not shown, connected to external rod 38. The internal piston subdivides the cylinder chamber into opposite chambers connected to steam valve 32 by lines 40 and 42 connected at appropriate ports 44 and 46 respectively. Preferably, the steam cylinder 36 is secured at plate 12 at a trunion mounting 50 to accommodate pivotal or rocking motion about the trunion pin. The lower ends of rods 38 are secured at spherical rod ends 52 to circular connecting plate 54. The spherical rod ends are of conventional construction such as a TRE series manufactured by Spherco, which permit oscillatory motion, rotation and angular misalignment.

Hydraulic cylinder 60 is oppositely positioned from steam cylinder 36 and is mounted on a trunion 62 so that steam cylinder 36 and hydraulic cylinder 60 are disposed on a line passing through the center of each cylinder and the center of the connecting plate 54. Hydraulic cylinder 60 is a linear actuator having a piston, not shown, connected to rod 64 terminating at spherical connection 66 at connector plate 54. Hydraulic cylinder 60 is a double acting cylinder having ports 68 and 70. Port 70 is connected to four-way pilot operated directional control valve 72 by line 74 and port 68 connected to valve 72 by line 78. The pressure existing in the lower cylinder chamber of cylinder 60 is imposed as a pilot signal via line 76 on the lower end of control valve 72. The pressure existing in the upper cylinder chamber is imposed as a pilot signal on the opposite end of directional control valve 72 by line 77. Four way directional control valve 80 is interposed between directional control valve 72 and reversible hydraulic motor 82. Accumulator 84 is connected to line 86 extending between valve 72 and 80 to minimize the pulsing of oil at the hydraulic cylinders to maintain even system pressure. Discharge from hydraulic motor 82 is directed to reservoir 88. The operation of the hydraulic system will be more fully explained hereafter.

Cantilever shaft 90 is secured to base plate 12 and extends concentrically from the bottom of plate 12. Shaft 90 supports connecting plate 54 at self-aligning ball bushing 92 held in place by nut 94 at the threaded end of shaft 90. Ball bushing 92, as shown in FIG. 3, may be of the type manufactured by Torrington and designated as Series SF. The centers of connections 52, 66 and bearing 92 should be on a common plane as shown in FIG. 2.

As the cylinder rods reciprocate, the cylinder connecting plate 54 acts as a lever with its center the fulcrum. Connecting plate 54 operates as a wobble plate and imparts rotary motion to swash plate 100 through thrust bearings 106 disposed between the swash plate and the connecting plate. The centers of bearings 52, 92, 106 and 66 are aligned along a common plane. Swash plate 100 is mounted on a journal 102 about fixed shaft 90. The upper end of journal 102 is connected to a rotating valve plate 112 which distributes valve steam to the appropriate steam cylinder 36, 36A, etc. and controls the return of steam and condensate to the condensor.

The valving arrangement is more fully illustrated in FIGS. 4–8 and includes an upper circular port plate 114 having a pair of ports 130 and 132 for each steam cylinder 36. Ports 130 are commonly connected to live steam line 30 from the steam chamber. Ports 132 are commonly connected to line 25 leading to an external condensor not shown. The return from the condensor is directed to the boiler via line 24.

Valve plate 110 is disposed below valve plate 114 and is provided with two pair of ports 136 and 138 vertically aligned with ports 130 and 132. Ports 136, 138, 130 and 132 are all aligned on a radius extending from the vertical center line of center shaft 90, connecting plate 54 and swash plate 100. The outer set of ports 136 are commonly connected via line 42 to upper port 46 of the steam cylinder 36. Similarly, the inner set of ports 138 are commonly connected via line 40 to lower port 44 of the steam cylinder. It will be obvious that when the upper cylinder chamber is connected to steam and the lower cylinder chamber connected to the condensor, cylinder rod 38 will be extended.

Figure 5:
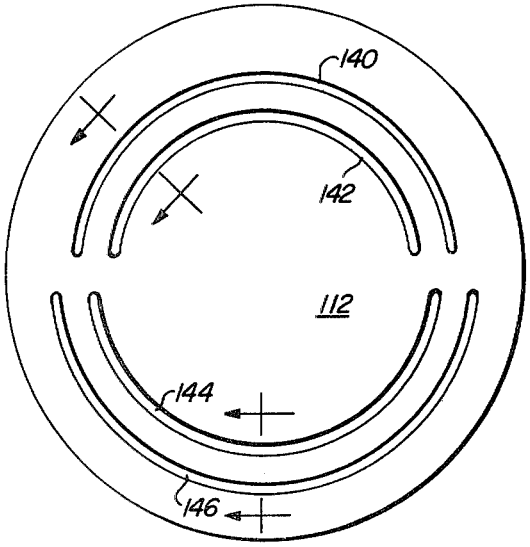
FIG. 5 is a sectional view taken along lines 5—5 of FIG. 1 illustrating the rotating valve plate.

As mentioned above, plate 112 is rotated by swash plate 100 through sleeve or journal 102. Rotary valve plate 112 is provided with two pairs of kidney slots 140, 142, 144 and 146. The kidney slots illustrated are preferably approximately 170° of arcuate extent and are arranged opposite each other as shown in FIG. 5 and being located at a radius corresponding to the radius of ports 130, 132 of plate 114 and ports 136 and 138 at port plate 110. For example, outer most slot 146 corresponds in radial location to outer most port 130 in plate 114 and port 136 of plate 110. The kidney slots 140, 142, 144 and 146 serve as manifold passageways to direct steam to the appropriate cylinder chamber and return steam and condensate to the condensor in response to the rotation of the swash plate and valve plate 112. The valve plate 112 is held in rotational engagement between port plates 110 and 114 by a pin 150 extending through aperture 152 in lower port plate 110. Pin 150 has an enlarged head 154 and biasing means, shown as a helical spring 156 extends between the head 154 and the lower surface of port plate 110.

Figure 7:
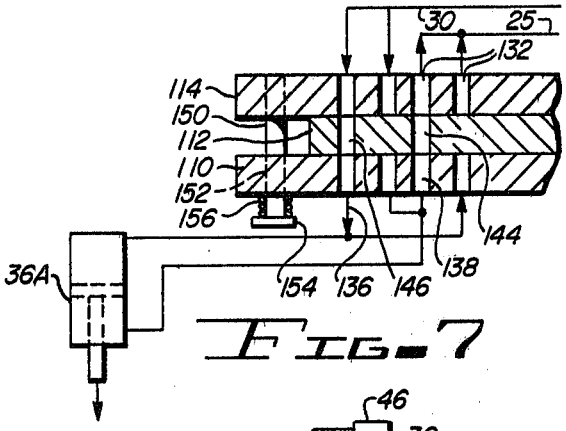
FIG. 7 is a sectional view taken along lines 7—7 of FIG. 4.
Figure 8:
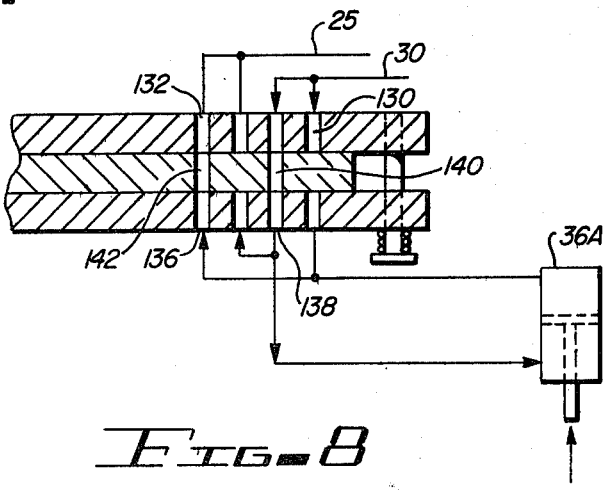
FIG. 8 is a sectional view taken along lines 8—8 of FIG. 4.

As illustrated in FIGS. 1, 7 and 8, swash plate 100 rotates in a known manner in response to the motion of the connecting plate 54. This rotational movement of the swash plate is transmitted by journal 102 to valve plate 112. Assuming an arrangement as shown in FIG. 10, and with steam cylinder 36A extending, valve plate 112 would be rotated to a position approximately as shown in FIG. 7 with kidney slot 146 communicating outer ports 130 and 136 directing steam from line 30 to the upper cylinder chamber via line 42. Return steam and water or condensate from the lower cylinder chamber will be directed via line 40 through port 138 and plate 110, kidney slot 144 and port 132 and upper port plate 114 to condensate line 125 directed to the condensor.

Figure 4:
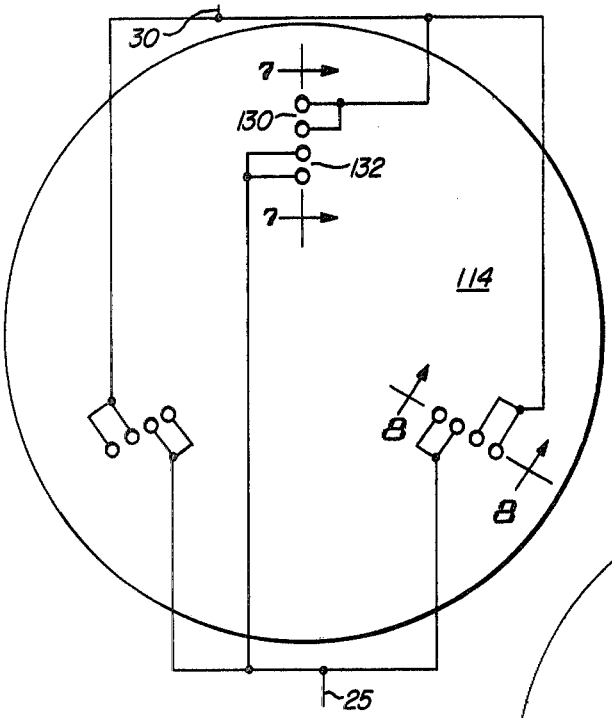
FIG. 4 is a sectional view taken along lines 4—4 of FIG. 1 illustrating the upper port plate with steam connections shown schematically.
Figure 6:
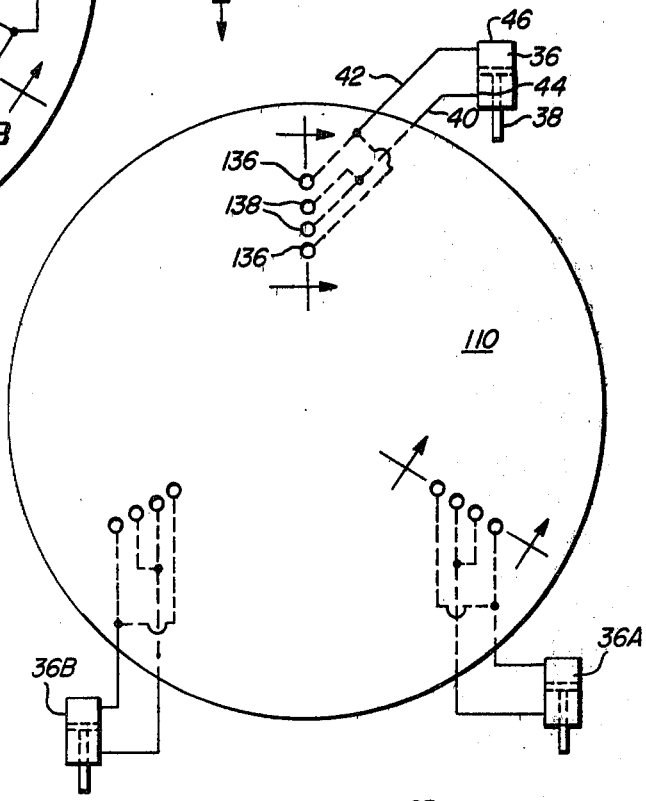
FIG. 6 is a sectional view taken along lines 6—6 of FIG. 1 illustrating the lower port plate with steam connections shown schematically.

Assuming counterclockwise rotation as viewed in FIGS. 4, 5 and 6, ports 136, 138, 130 and 132 associated with steam cylinder 36B will also be interconnected in the manner shown in FIG. 7 through kidney slots 144 and 146 in the initial portion of the extension stroke. Cylinder 36A will be on retraction stroke connected as shown in FIG. 8 with the return from the upper cylinder chamber of cylinder 36A being directed to condensate line 25 through port 136, kidney slot 142, and port 132. Steam from the boiler is valved from line 30 across port 130, kidney slot 140 and lower port 138 to the lower cylinder chamber of cylinder 36A to cause retraction of the steam cylinder.

It will be apparent that as the steam cylinder is cycled in and out, the opposite hydraulic cylinder will similarly cycle on a one-to-one ratio with extremely efficient energy transfer from steam power to hydraulic power. Combining this action with the swash plate imparts an acceleration and deceleration to the cylinder stroke resulting in smooth operation. This makes possible the conversion of the steam cylinder linear motion to a controlled rotation which is imparted to the valve plate of the steam distribution valve. The distribution valve controls the in and out power strokes of the steam cylinders to synchronize their action for smooth, even pumping of hydraulic fluid from the hydraulic cylinder 60. The action of the swash plate and cylinder connecting plate is one of position and control.

In operation, steam boiler 14 generates steam in a conventional manner which is distributed to the steam cylinders 36, 36A and 36B through the distribution valve 32 on a continuous basis. The pressure fluid flow from the hydraulic cylinders 60, 60A and 60B is directed to the hydraulic control valve 72 which shifts in response to pilot pressure sensed in lines 76 and 78 to maintain a positive flow to motor 82. Hydraulic fluid is directed into and out of the hydraulic cylinder by the four way pilot operated spool valve 72. The pilot ports to the valve are connected to sense the pressure in the opposite cylinder chambers of the hydraulic cylinder 60. As the cylinder direction is reversed, pilot pressure will move the spool of the valve 72 so that the fluid on the pressure side of the cylinder is always directed to hydraulic motor. Note the hydraulic cylinders 60, 60A and 60B may be directed to a common hydraulic motor or each may be provided with a separate motor and system as shown or any combination.

Directional control valve 80 controls the speed and direction of rotation of the reversible hydraulic motor 82. With directional control valve 80 in a flow blocking condition, hydraulic cylinder 60 will not move which causes stalling of the steam cylinder. As the steam pressure approaches the maximum set point, an appropriate control, not shown, will reduce the flame in the steam generator to hold desired maximum pressure. Thus, when no rotary motion is required, no energy will be wasted. When rotary motion is required, directional control valve 80 will open sufficiently to allow hydraulic fluid to flow to the motor 82 and as a pressure head is available on the steam side of the system, the steam cylinders will cycle at the desired rate as determined by the directional control valve 80. As steam is used to cycle the cylinder, the pressure in the steam generator will drop and the sensing control will increase the rate of flow of fuel to the flame to generate more steam as needed.

Figure 9:
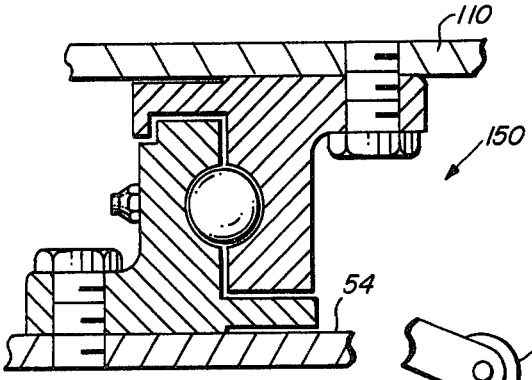
FIG. 9 is an enlarged view of the bearing arrangement shown in FIG. 2.

FIG. 2 shows an alternate embodiment for the swash plate and connecting plate arrangement. As in FIG. 1, connecting plate 54 is again connected to the ends of steam cylinder rod 38 and hydraulic cylinder rod 64 at spherical rod ends 52 and 66 as has been described above. Connecting plate 54 is provided with a central aperture 55 to permit the connecting plate 54 to wobble without interference with journal 102 held on shaft 90 by nut 94. Swash plate 110 is secured to journal or sleeve 102 and serves to impart rotational motion to a valve plate 112. Bearings 150, as shown in detail in FIG. 9, are interposed between the swash plate and the connecting plate and bearings 150 are the type designated Econo-Trak, Series 2000, bearings of the type manufactured by Rotek and designed to accomodate and transfer thrust and moment loads.

In other respects, the unit embodiment shown in FIG. 2 is as has been described with reference to FIG. 1 and 3 to 8 with the wobble motion of the connecting plate imparting rotary motion to the swash plate through bearings 150. Valving and other components are as have been described.

Figure 11A:
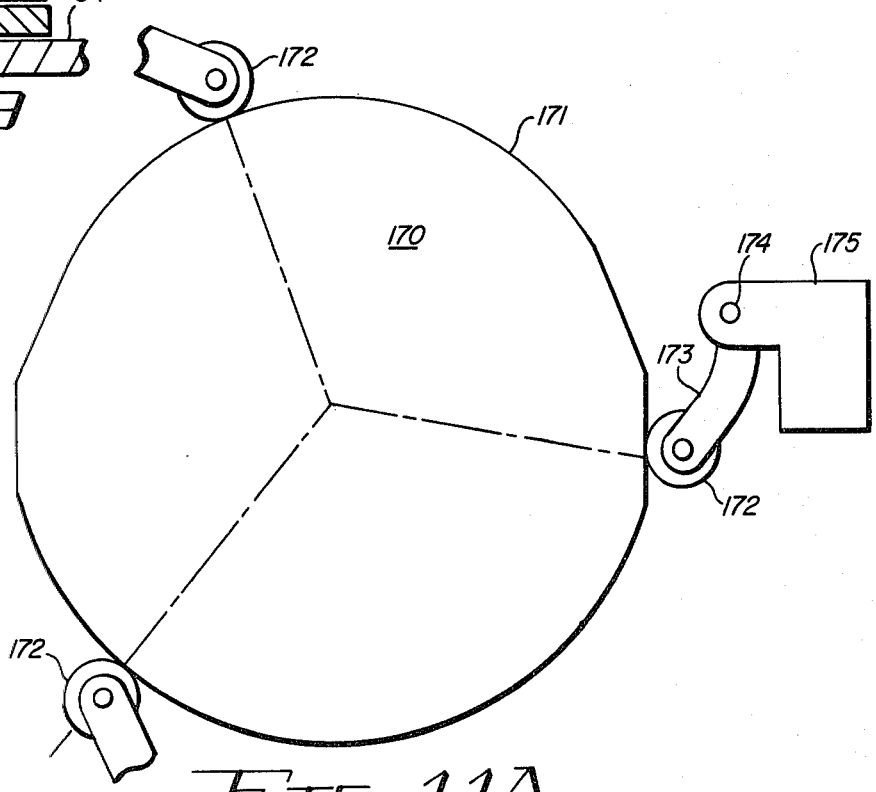
FIG. 11A is a sectional view taken along lines 11A—11A of FIG. 11.
Figure 11:
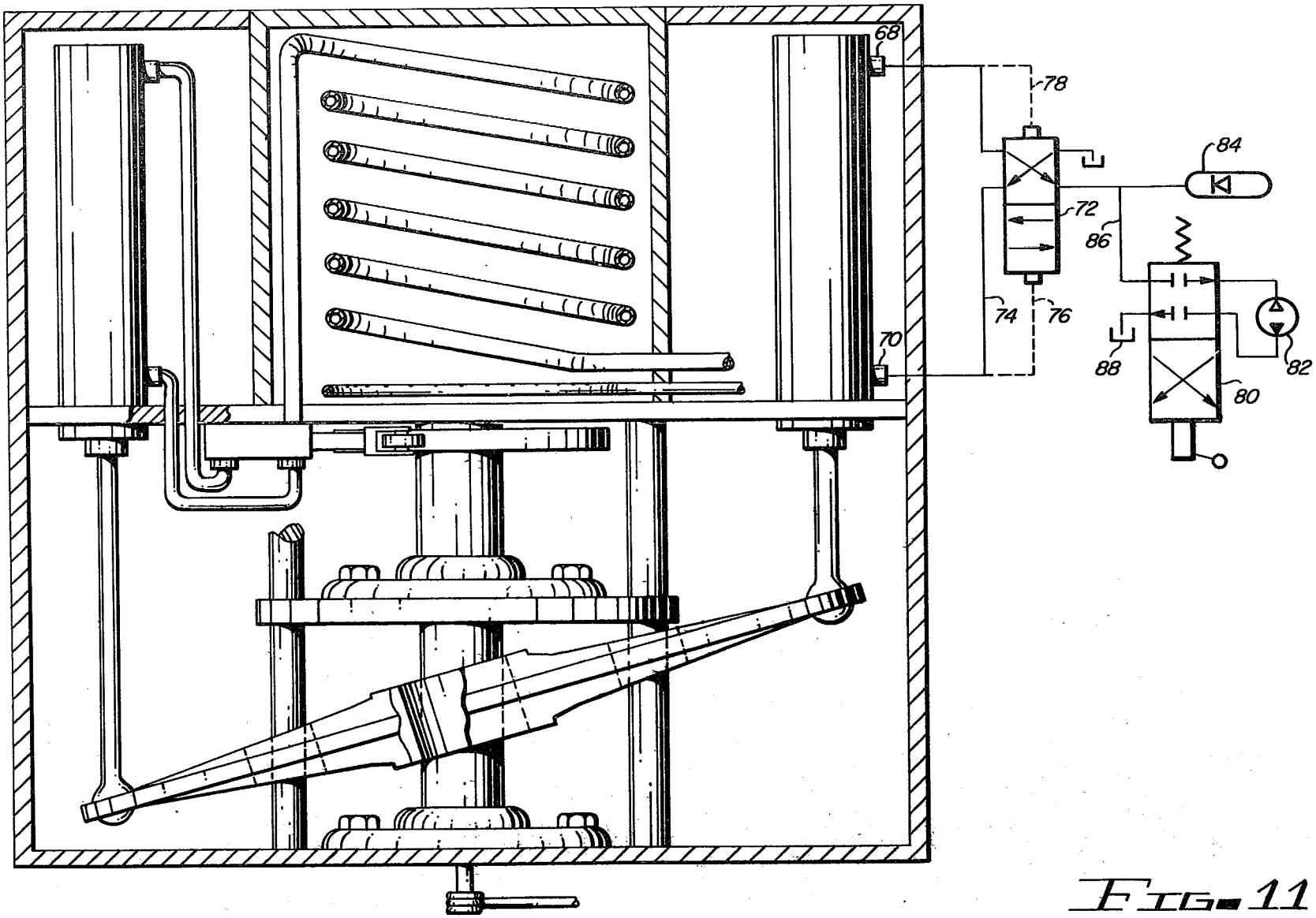
FIG. 11 is a partial side view illustrating an alternate arrangement for valving the steam cylinder.

FIG. 11 shows another embodiment of the present invention generally designated by the numeral 160. Embodiment 160 is similar to the embodiment shown and described with reference to FIG. 1 with the exception that the steam distribution valve is modified with a rotating cam plate 170 actuated through swash plate 100. The steam cylinders, hydraulic cylinders, boiler connecting plate and other components are as have been described and detailed description is not believed necessary.

Figure 12:
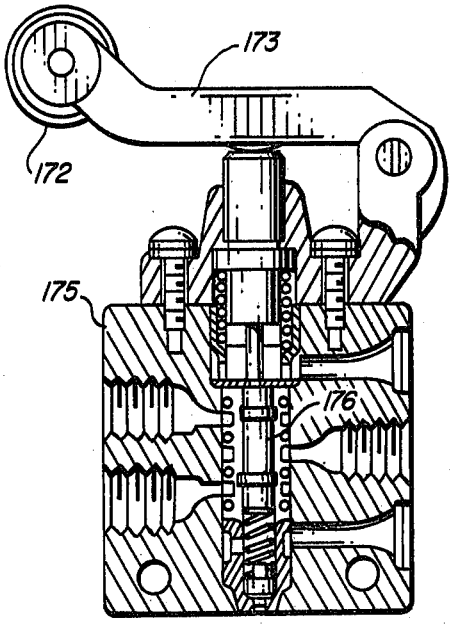
FIG. 12 is a cross sectional view showing the details of the cam actuated valve shown in FIG. 11.

Cam plate 170 is illustrated in FIG. 11A and is provided with a peripheral cam surface 171. A plurality of steam control valves 175, as shown in detail in FIG. 12, are arranged about the periphery of the cam plate 170. One four-way valve is provided for each steam cylinder to direct steam from the boiler to the cylinder and return steam to the condensor. As seen in FIGS. 11A and 12, each of the valves 175 includes a cam follower 172 mounted on arm 173 pivotally attached to the valve at 174. Pivotal movement of arm or lever 173 will, in turn, impart axial movement to spool or plunger 176 to selectively direct flow across the ports valve 175. Thus, by proper configuration of surface 171, valve 175 can be used to direct steam to and from steam cylinders.

Figure 13:
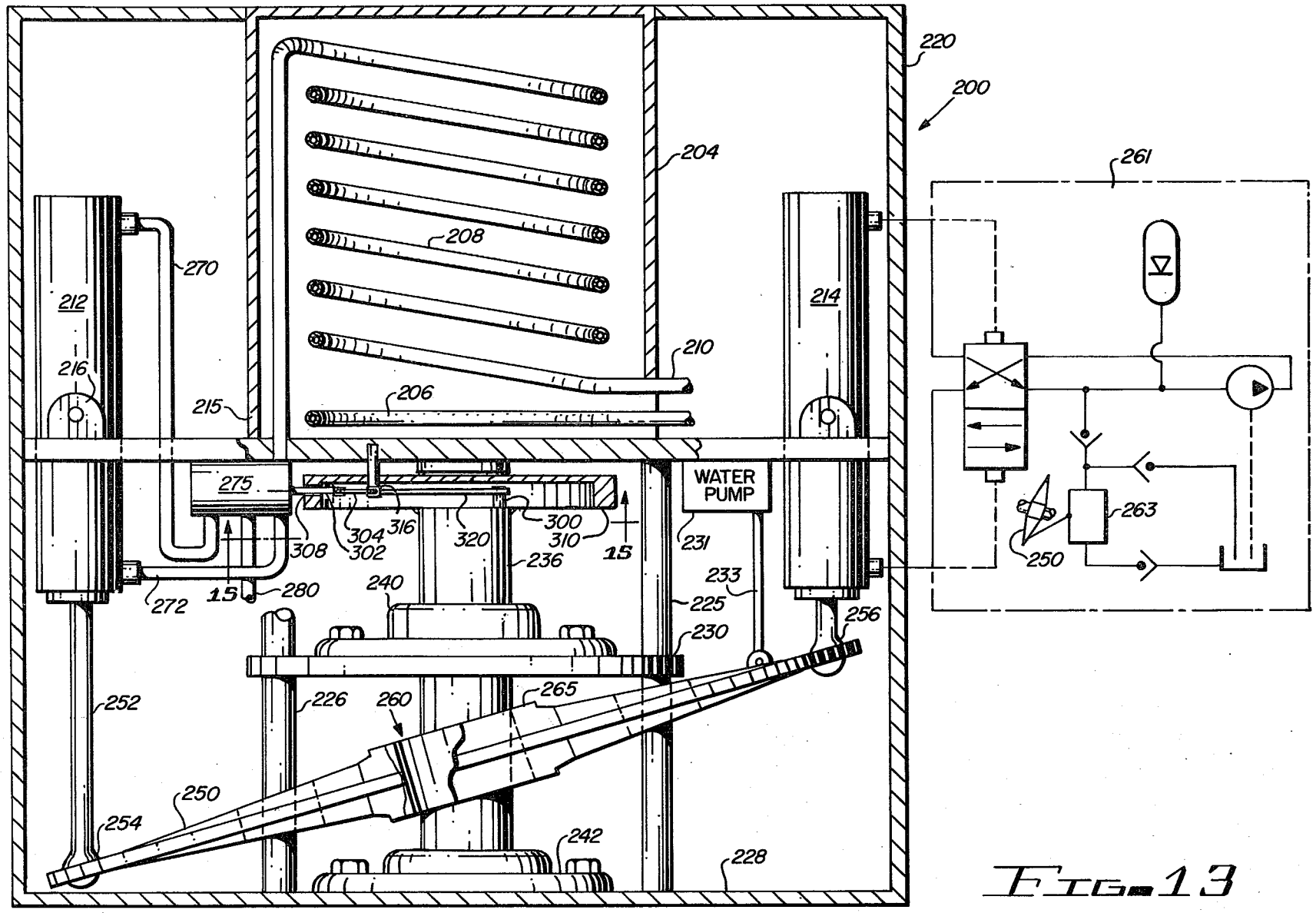
FIG. 13 is a side view of another embodiment of the present invention.
Figure 14:
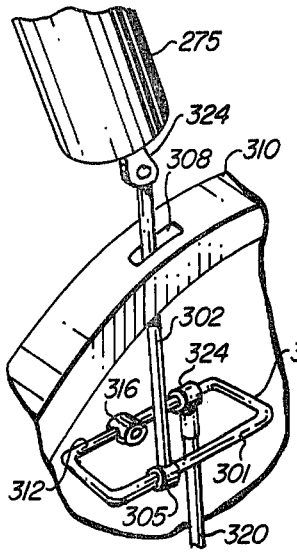
FIG. 14 is a detailed view showing the crank and rod mechanism connecting the slide valves and shaft assembly.

FIG. 13 illustrates an alternate embodiment of the present invention generally designated by the numeral 200. Embodiment 200 includes a transverse base or mounting plate 202 which supports a shell or housing 204 enclosing burner 206, boiler heating coils 208, feed water line 210 and discharge line 215. At least one pair of steam and hydraulic cylinders 212 and 214 are oppositely disposed on the base plate and secured thereto by appropriate trunion brackets 216. For safety, an enclosure 220 is provided around the entire power unit 200. Support columns 225 and 226 extend between base plate 202 and bottom 228 of enclosure 220. Upper bearing support 230 extends transversely between extensions 225 and 226. Shaft 236 is concentric within the unit and is rotatably mounted in upper bearing 240 located on bearing support 230 and lower bearing 242 secured to bottom plate 228. Swash plate 250 is connected to the outer end of steam cylinder rod 252 at spherical bearing 254. Similarly, the outer end of the rod of hydraulic cylinder 214 is connected to the swash plate at spherical bearing 256. Bearing 265 is interposed between the shaft and swash plate. The "wobble" of swash plate 250 is translated to rotary motion at shaft 236 through the inner race of bearing 265. Hydraulic system 261 is operatively connected to cylinder 214 and system 261 is a closed loop system and control function occurs by regulating the slide valve 275 as will be described. In reference to prior embodiments, in FIG. 1 control was achieved by control valve 80 or by a load imposed. Increasing the stroke of slide valve 275 to admit more steam to the steam cylinders will increase the power output at hydraulic motor 281. Pilot valve 283 directs hydraulic fluid to motor 281.

Water pump 231 is positioned on the underside of plate 202 and is operated by plunger 233 pivotally connected to swash plate 250. Pump 231 provides make-up water to the boiler system. Similarly hydraulic make-up pump is operable from swash plate 250.

Figure 17:
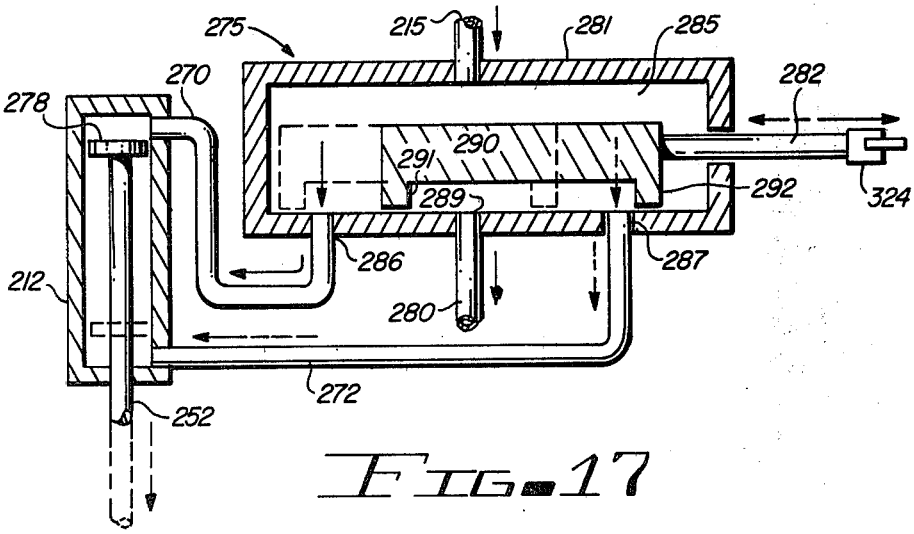
FIG. 17 is an enlarged sectional view of the slide valve.

As best seen in FIG. 17, a slide valve 275 controls the valving of steam and condensate return for each steam cylinder 212. Slide valve 275 is connected to the opposite cylinder chambers at opposite sides of steam piston 278 by lines 270 and 272 respectively. Rod 252 is reciprocated along with piston 278. Return line 280 connects valve 275 with a condensor, not shown. Inlet 215 connects to a source of steam and, as shown, is connected to coils 208. The valve construction shown in FIG. 17 includes a generally rectangular valve housing 281 defining rectangular steam chamber 285. Valves of this general type are often designated steam chest valves having steam ports 286 and 287 horizontally spaced apart. Return line 280 connects with chamber 285 at port 289 intermediate ports 286 and 287. Valve slide 290 is horizontally reciprocal within the valve chamber 285 by means of rod 282. Slide 290 includes two spaced apart downwardly extending "laps" 291 and 292. With the valve and the slide in the position shown in solid in FIG. 17, steam is admitted to the steam chamber via line 215 and discharged at port 286, through line 270 to upper or head cylinder chamber. In this position, steam return from the rod chamber enters the slide valve by means of line 272 at port 287 and is communicated from the valve at port 289. Similarly, the valve is reciprocated leftwardly to the position shown in dotted lines, the reciprocation of piston 278 is reversed as live steam is now directed from input line 212 through port 287, through line 272 to the lower or rod end cylinder chamber of steam cylinder 212.

Figure 15:
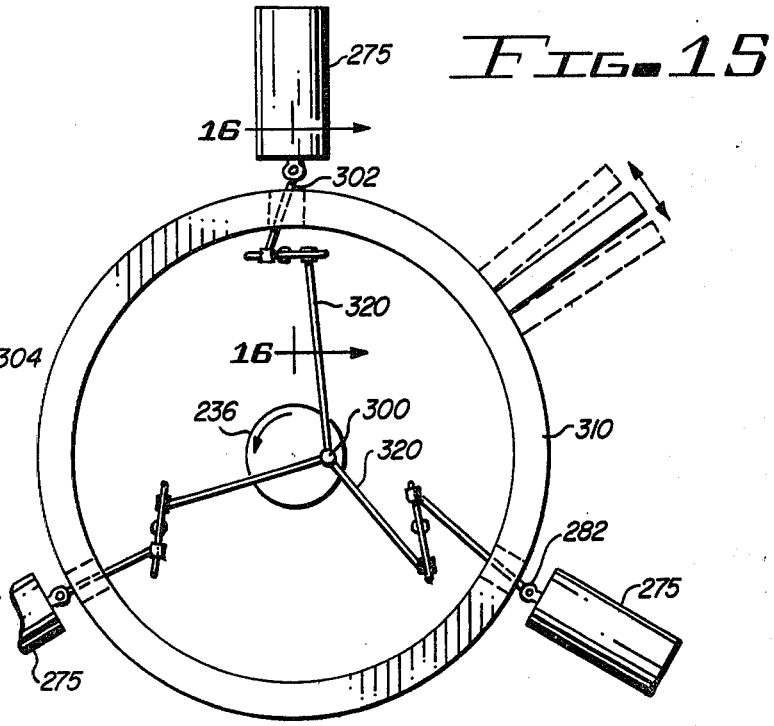
FIG. 15 is a sectional view taken along lines 15—15 of FIG. 13 illustrating the valving utilized in the embodiment of FIG. 13.
Figure 16:
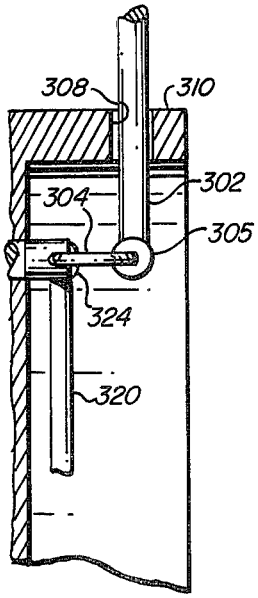
FIG. 16 is a view taken along lines 16—16 of FIG. 14.

Actuation of valve 275 is accomplished by an adjustable linkage actuated through an eccentric pivot 300, secured to the upper end of stub shaft 236. As best seen in FIGS. 13 and 15, pivot 300 is eccentrically positioned on the top of shaft 236. Linkage 302 is pivotally connected at pivot 300. Note that a separate slide valve is provided for each steam cylinder, only one however will be described as detailed description of one applies to all units. Linkage 302 is connected to slide connector 304 at head 305. Note that link 302 extends through an aperture 308 in circular collar 310 which is positioned about the upper end of stub shaft 236. Head 305 is slidable along arm 301 of slide connector 304. A second arm 312 is vertically spaced apart from arm 301 and secured at pivot point 316 so the entire slide connector 304 can "rock" or pivot. Crank arm 320 is pivotally secured to arm 312 at head 324. The opposite end of crank arm 302 is secured to valve slide 282 at clevis 324. The power stroke of steam cylinder can be controlled by controlling the stroke of slide 290 by positioning head 305 of link 302 along arm 301. This is accomplished by rotating collar 310.

Figure 18:
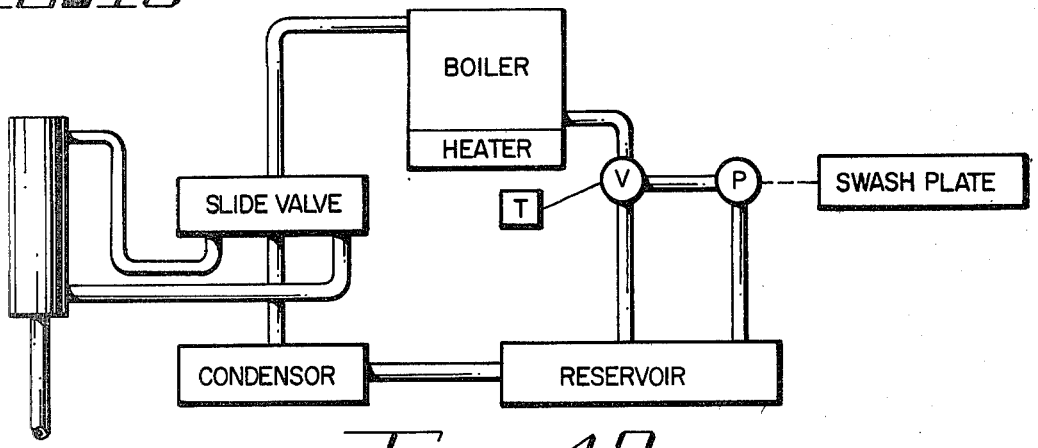
FIG. 18 is a schematic of the system carried out by the device of FIG. 13.
Figure 19:
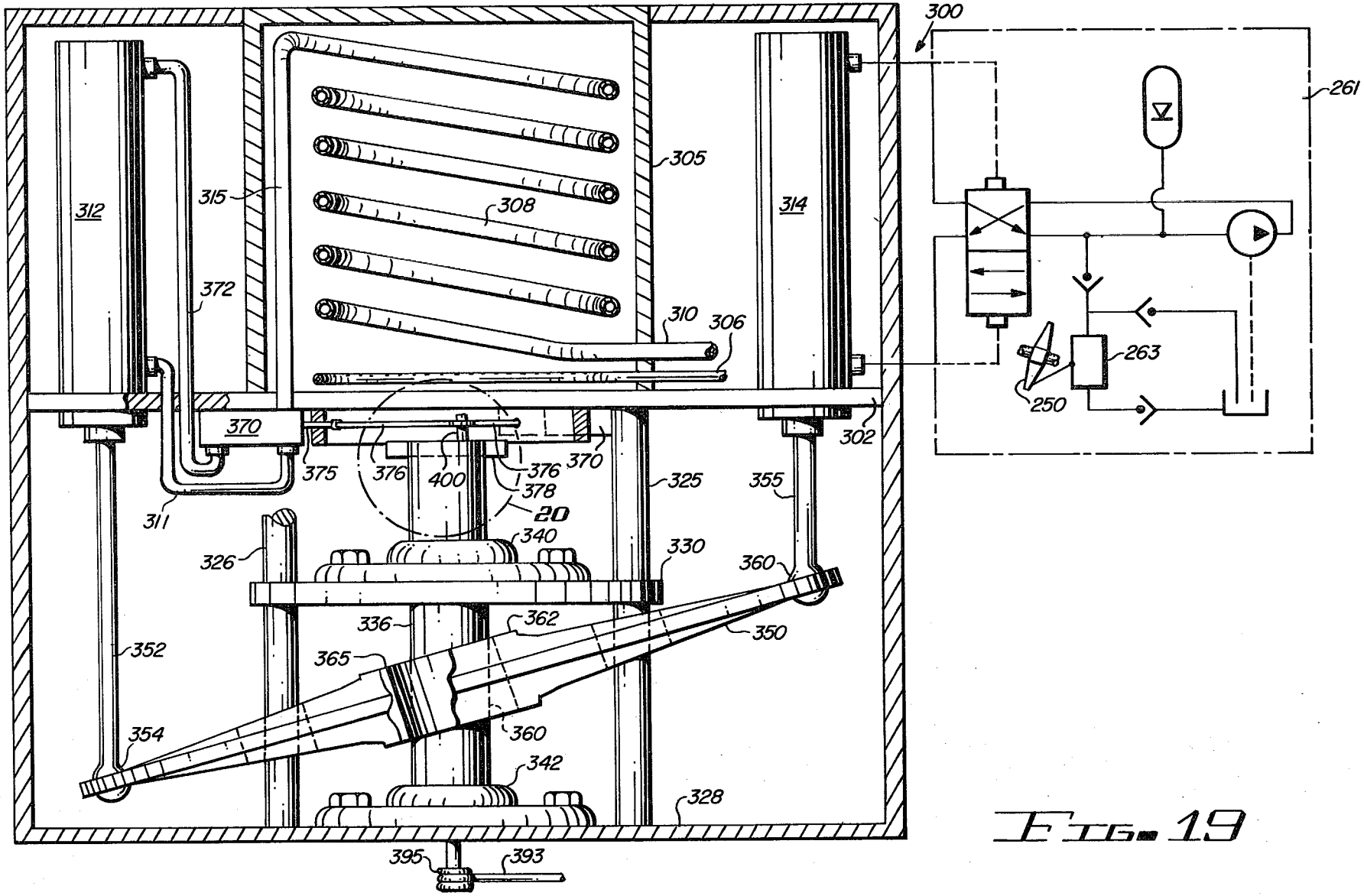
FIG. 19 illustrates another embodiment of the present invention.
Figure 20:
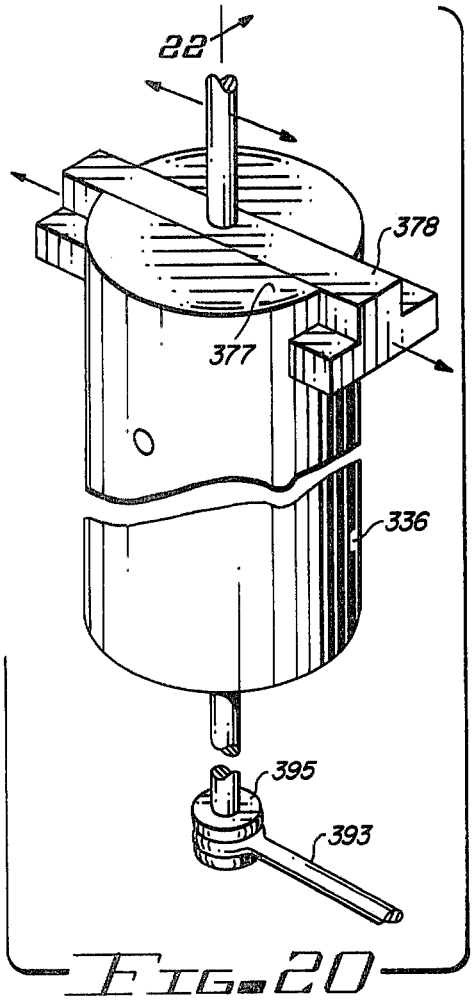
FIG. 20 is a perspective view of the shaft as indicated in FIG. 19.
Figure 21:
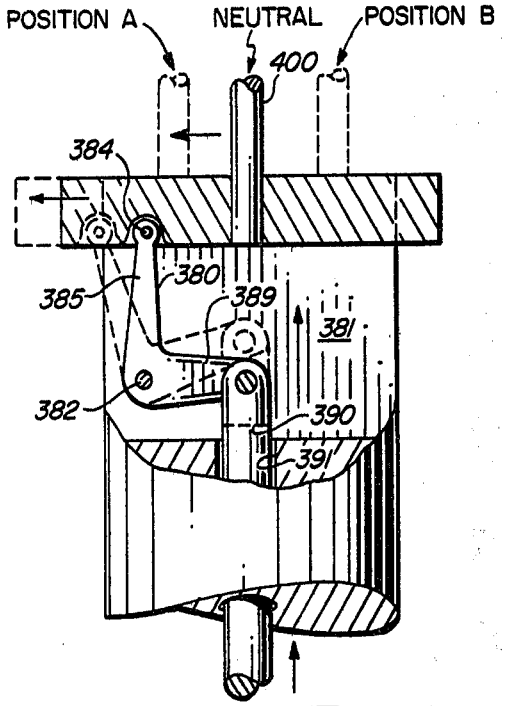
FIG. 21 is a veiw of the control shaft partly broken away.

FIG. 18 schematically illustrates the system described above and in FIGS. 13 to 17.

FIGS. 19 to 23 illustrate still another embodiment of the present invention generally designated by the numeral 300. Embodiment 300 includes a transverse base or mounting plate 302 which supports boiler enclosure 305, burner 306 and boiler coils 308. Feed water is introduced into the boiler at line 310 and discharged from the boiler as steam at line 315. For safety an outer housing extends about the entire unit.

At least one pair of steam and hydraulic cylinders 312 and 314 are oppositely located on base 302 and secured thereto by appropriate trunnion brackets. Support columns 325 and 326 extend between base plate 302 and bottom 328 of the enclosure 304. An upper bearing support 330 extends transversely between extensions 325 and 326. Shaft 336 extends concentrically within the unit and is rotatably mounted in upper bearing 342 secured to bottom plate 328. Swash plate 350 is connected to the outer end of steam cylinder rod 352 at spherical bearing 354. Similarly, the outer end of rod 355 of hydraulic cylinder 314 is connected at spherical bearing 360 to swash plate 350. Swash plate 350 is disposed about shaft 336 at hub 362 and thrust bearing 365. Thrust bearings 365, for example, may be steep-angled type TNAS bearing providing for extra high thrust capacity such as the type manufactured by the Timpkin Roller Bearing Company. Reciprocation of swash plate 350 under the influence of the steam cylinder 312, imparts rotary motion to shaft 336.

Shaft 336 is used to operate steam valve 370 connected to steam cylinders 312 by lines 311 and 372. Steam valve 370 is similar to the valve described with reference to FIG. 17 and detailed description of the construction of the valve is not deemed necessary.

Figure 23:
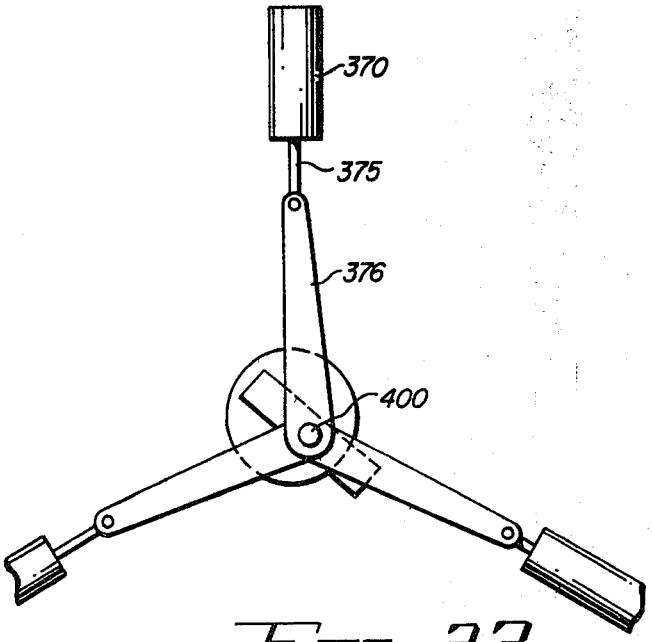
FIGS. 22 and 23 show operating positions of the control slide.
Figure 22:
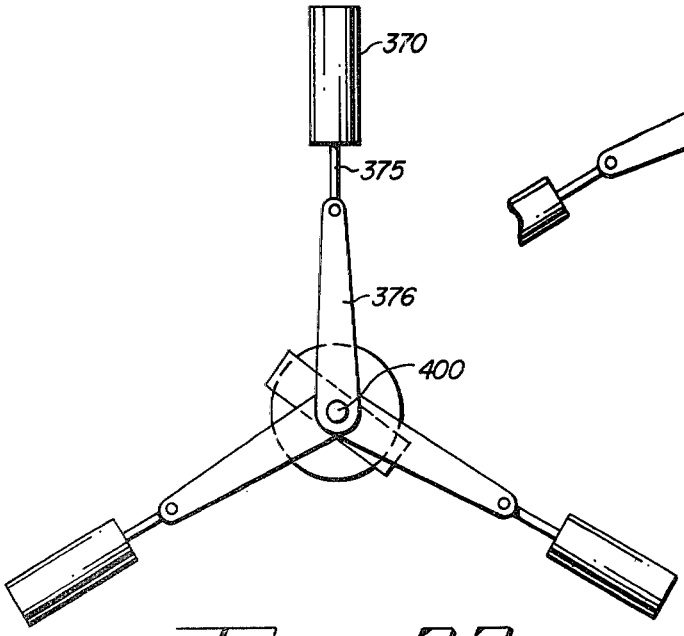

Valve 370 is a slide valve operable by rod 375. Rod 375 is reciprocated by a control mechanism as best shown in FIGS. 22 and 23. Shaft 336 is provided with a generally transversely extending slot 377 in the form of an inverted "T". Slide 378 is transversely reciprocal in slot 377. Bell crank 380 is located in recess 381 subjacent slide 378. Bell crank 380 is pivotal on pin 382. Arm 385 of bell crank 380 is connected to slide 378 at pin 384. The oposite arm 389 of bell crank 380 is pivotally connected to control shaft 390 extending concentrically within bore 391 of shaft 336. Control lever 393 is connected to the lower end of shaft 390 at bearing members 395. Shaft 390 can be axially displaced by movement of lever 393. Movement of rod 390, in turn, causes slide 378 to be transversely displaced relative to shaft 336. This movement transversely displaces vertical control pin 400 to a position along the diametral path from position "A" to position "B" as shown in FIG. 22. Rod 375 of steam valve 370 is connected to control pin 400 by arm 376.

It will be apparent that as the control link or lever 393 is raised or lowered, the relative position of the slide valve control pin 400 will change. The position of the slide valve control pin 400 controls the steam cylinder power stroke and the direction of travel of the power stroke. For example, with the slide valve control pin 400 in the center position as shown in solid in FIG. 22, the steam valve will be moved to the center, neutral position. Displacing the pin on either side of the center position, that is, towards positions "A" or "B" will regulate available power on the power stroke and whether power is delivered in the extension or retraction portion of the cycle.

The slide valve arrangement shown in FIGS. 19 to 23 has another important advantage. With this arrangement the slide valve, control pin and swash plate operate to always maintain the proper phase relationship when adjustments are made. With the embodiment shown in these figures, speed and power can be controlled at the slide valve whereas with previous embodiments, power control is regulated at the directional control valve as seen in FIG. 1. The hydraulic circuit connected to the hydraulic cylinders is a closed loop system similar to that shown in FIG. 13.

Another advantage of the present invention resides in the compact arrangement with the cylinders disposed about the boiler. All steam components are centrally located and enclosed for safety.

In some instances it may be desireable to provide two or more steam cylinder cycling each hydraulic cylinder. In this case, the steam cylinders would be connected to the connecting plate at a common pivotal point and the cylinders reciprocated in unison. Other arrangements in which the steam and hydraulic cylinders are symetrically positioned or in a balanced arrangement would be operable.

From the foregoing, it will be seen that the present invention provides an efficient, compact and novel power conversion system. It will be obvious to those skilled in the art to make various changes, alterations and modifications. To the extent that these changes, alterations and modifications do not depart from the spirit and scope of the appended claims, they are intended to be encompassed therein.

I claim:

1. A power conversion system for converting steam power to hydraulic fluid power comprising :

(a) a base;

(b) at least a linear steam cylinder and a linear hydraulic cylinder radially disposed on said base in generally parallel alignment for pumping hydraulic fluid;

(c) steam generating means intermediate said steam and hydraulic cylinders;

(d) a wobble-type connecting plate pivotally connected to the ends of the cylinder rods and being pivotal about a point centrally located between said cylinders whereby said hydraulic cylinder is oppositely actuated as said steam cylinder is powered on a one-to-one relationship; and (e) valving means actuated by said connecting plate for directing steam into and out of said steam cylinder.

2. The system of claim 1 wherein a plurality of oppositely disposed linear steam and hydraulic cylinders are provided in a circular arrangement with said steam generating means generally concentrically disposed within said arrangement.

3. The system of claim 1 wherein said steam generating means, linear steam cylinders and steam valving means are enclosed within a common housing.

4. The power conversion system of claim 1 further including a swash plate in driven engagement with said connecting plate and whereby said valving means is positioned by said swash plate.

5. The power conversion system of claim 4 wherein said valving means includes cam means and a directional control valve having a lever arm positionable by said cam means.

6. The power conversion system of claim 1 wherein said connecting plate is in driving engagement with a control shaft and further including linkage means interconnecting said control shaft and said valving means.

7. A power conversion system for converting steam power to hydraulic fluid power comprising:

(a) a base;

(b) at least one linear steam cylinder and one linear hydraulic cylinder oppositely disposed on said base in generally parallel arrangement, each having a piston and rod cylinder;

(c) steam generating means intermediate said steam and hydraulic cylinders for generating steam;

(d) a pivotal connecting plate pivotally secured to the ends of the cylinder rods and driven by the reciprocation of the steam cylinders and driving the hydraulic cylinder through the hydraulic cylinder rod on a one-to-one relationship;

(e) control shaft means concentrically positioned with respect to said plate and rotatable thereby;

(f) a steam chest valve for controlling flow of steam into and out of said steam cylinders;

(g) control means for regulating the admission and discharge of steam to and from said steam cylinders comprising:

(i) slide means transversely positionable along said control shaft;

(ii) a control pin on said slide means and moveable therewith;

(iii) linkage means connecting said control pin and said steam chest valve; and (iv) means for displacing said slide means thereby regulating the operation of said steam valve whereby the duration of time the steam chest valve is open to admit steam on the power stroke may be regulated.

8. A power conversion system for converting steam power to hydraulic fluid power comprising:

(a) a base;

(b) at least one linear steam cylinder and one linear hydraulic cylinder oppositely disposed on said base in generally parallel arrangement, each having a piston and rod cylinder;

(c) steam generating means intermediate said steam and hydraulic cylinders for generating steam;

(d) a pivotal connecting plate pivotally secured to the ends of the cylinder rods and driven by the reciprocation of the steam cylinders and driving the hydraulic cylinder through the hydraulic cylinder rod on a one-to-one relationship;

(e) control shaft means concentrically positioned with respect to said plate and rotatable thereby;

(f) a steam chest valve for controlling flow of steam into and out of said steam cylinders;

(g) control means for regulating the admission and discharge of steam to and from said steam cylinders comprising:

(i) a control pin on said control shaft;

(ii) linkage means interconnecting said pin and said steam chest valve;

(iii) means for adjusting said linkage to regulate the stroke of said steam valve whereby the duration of time the steam chest valve is open to admit steam on the power stroke may be varied.

* * * * *